United States Patent [19]

Johnson

[11] Patent Number: 4,505,012

[45] Date of Patent: Mar. 19, 1985

[54] SLING SWIVEL

[76] Inventor: David A. Johnson, 3432 Tanglewood Way, Salem, Oreg. 97302

[21] Appl. No.: 470,712

[22] Filed: Feb. 28, 1983

[51] Int. Cl.[3] ..... F41C 23/02

[52] U.S. Cl. ..... 24/643; 24/2.5; 24/652; 24/656; 42/85; 224/150; 224/913

[58] Field of Search ..... 24/2.5, 265 R, 265 AL, 24/265 H, 265 CD, 298–302, 373–376, 231, 238, 239, 588, 589, 629, 643–645, 647, 648, 652–654, 656, 662, 664, 677, 609–613; 248/359, 360; 42/85; 224/150, 257, 258, 913

[56] References Cited

U.S. PATENT DOCUMENTS

| | | | |
|---|---|---|---|
| 575,164 | 1/1897 | Perkins et al. | 42/85 |
| 1,471,537 | 10/1923 | Wills et al. | 24/656 X |
| 2,446,197 | 8/1948 | Sloan | 224/913 X |
| 2,843,908 | 7/1958 | Koelling | 24/656 |
| 3,130,466 | 4/1964 | Carter | 24/653 |
| 3,704,537 | 12/1972 | McKinzie | 42/85 |
| 4,209,157 | 6/1980 | Edmisten | 42/85 X |
| 4,425,689 | 1/1984 | Fildan | 24/664 |

FOREIGN PATENT DOCUMENTS

| | | | |
|---|---|---|---|
| 1138193 | 10/1962 | Fed. Rep. of Germany | 42/85 |

*Primary Examiner*—William E. Lyddane
*Assistant Examiner*—James R. Brittain
*Attorney, Agent, or Firm*—Chernoff, Vilhauer, McClung, Birdwell & Stenzel

[57] ABSTRACT

A sling swivel for removably attaching a sling of flat webbing or other strap material to a rifle or other firearm includes a loop member for receiving the webbing. The loop has a neck extending away from one side. A pivotable shaft carrying a movable link member extends through the neck and is spring-biased to urge the movable link toward the neck. A mounting pin is mounted on one end of the movable link member and is slidably receivable in a hole associated with the neck or a fixed link member. Moving the movable link from its normal position allows the mounting pin to be placed through an eye on a rifle, to attach the swivel to the rifle. The spring-biased pivotable shaft mounting pin is received within the hole. A stop extending from the neck, alongside the movable link, protects the movable link against being pushed away from the neck by an eye of a rifle on which the swivel may be mounted. The loop and neck are preferably of fiber reinforced plastic material, and a fixed link including the hole for the mounting pin is attached to the neck by a rivet whose head protrudes on the side of the neck where the movable link is located. The movable link includes a hole which receives the head of the rivet which connects the fixed link to the opposite side of the neck. The end of the pivotable shaft opposite the movable link may be recessed to help prevent inadvertent release of the swivel from a rifle.

23 Claims, 11 Drawing Figures

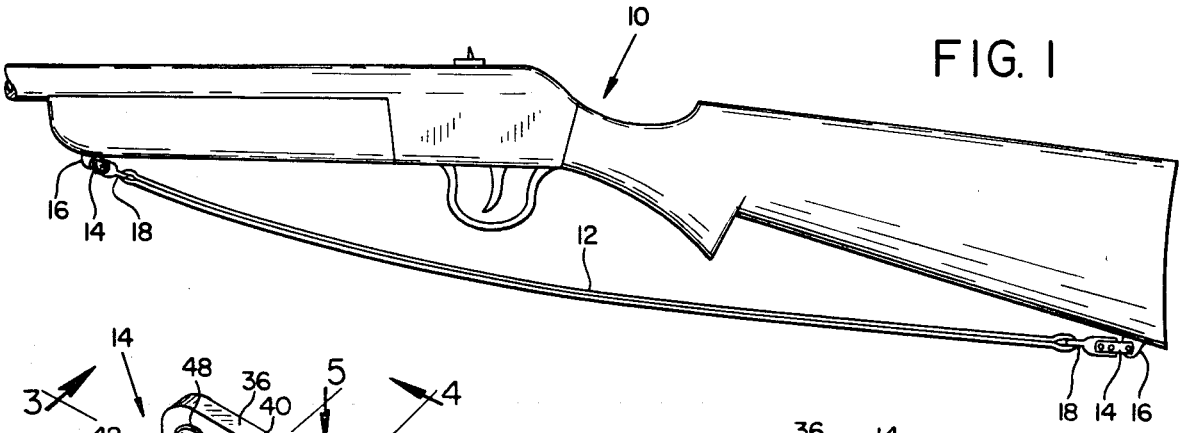
FIG. 1
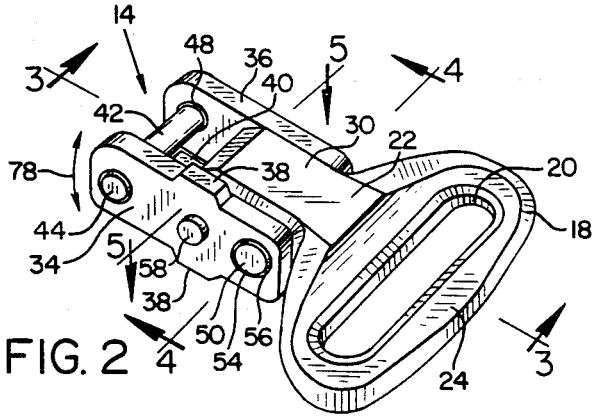
FIG. 2
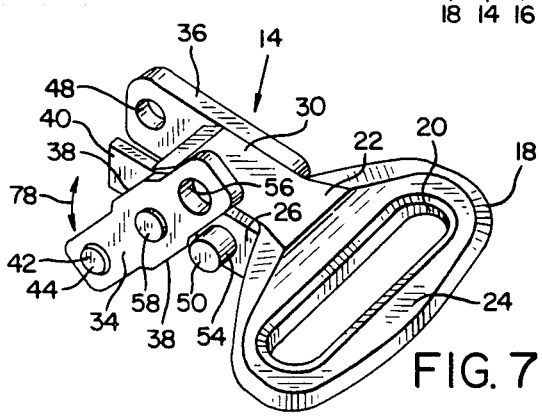
FIG. 7
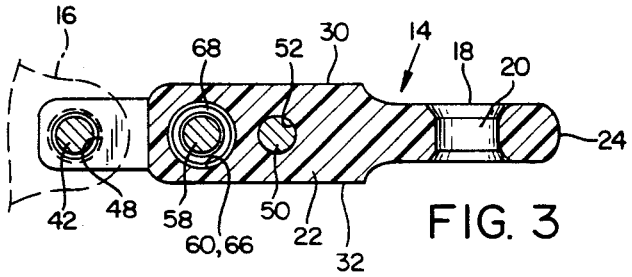
FIG. 3
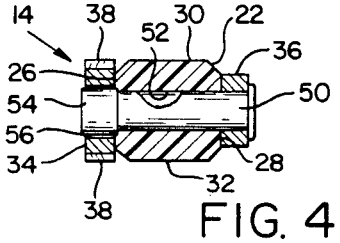
FIG. 4
FIG. 5
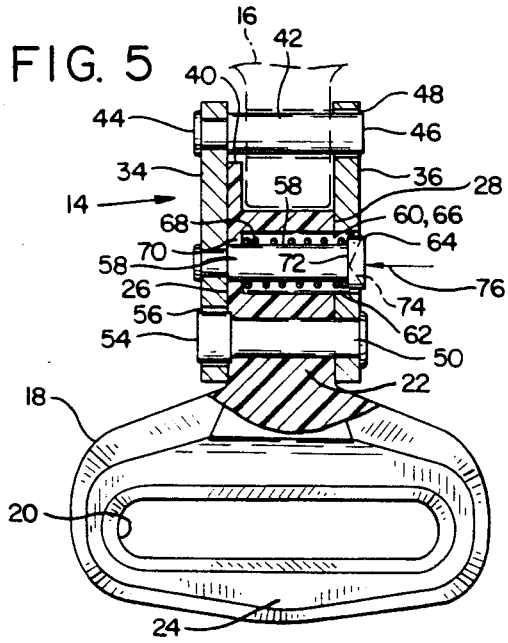
FIG. 6
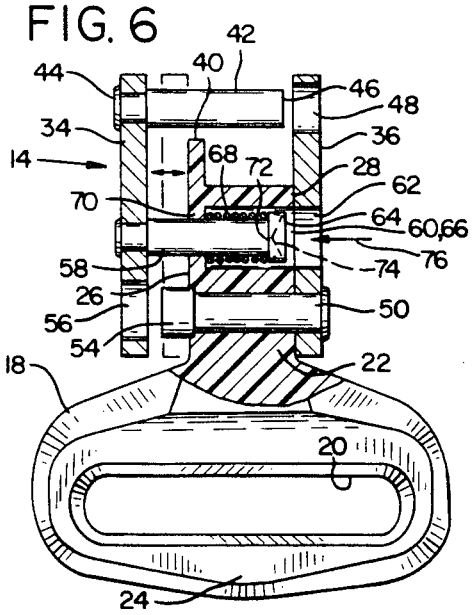

SLING SWIVEL

BACKGROUND OF THE INVENTION

The present invention relates to swivels for attaching slings to rifles and other weapons.

Military and hunting rifles, automatic weapons, and lightweight machine guns are frequently equipped with slings used in both carrying and shooting the weapons. Usually such slings are straps of leather or fabric webbing extending through wide loops pivotably attached to eyes located near opposite ends of the weapon. It is often desirable to be able to remove the sling easily from a weapon, as while cleaning the weapon or to permit the sling to be adjusted for use in a particular shooting positions. Easily detachable sling swivels are available but have certain drawbacks.

A sling swivel must be strong enough to support the weight of a weapon and to absorb other miscellaneous forces resulting while the weapon is being shot, but light weight is desirable since additional weight requires additional work by the person carrying the weapon. The need for strength has previously resulted in such sling swivels being made of metal, since the amount of space at the point of attachment of the sling to the weapon is usually somewhat limited and the eye used to attach the sling to the weapon is therefore usually quite small.

A previously known type of sling swivel that is easily removable from a weapon includes a metal main body defining a pair of sockets which receive the ends of a generally "C"-shaped heavy wire loop through which the sling webbing or strap material may be placed. A side member protrudes from the main body and a mounting pin extends from the side member. A pivot pin mounted in the metal body has a small plate attached to it adjacent the side of the body opposite the protruding side member. A hole is provided in the plate, spaced away from the pivot pin. The pivot pin is axially movable, but spring biased to hold the plate adjacent to the body, with the outer end of the pin fitting slidably within the hole, so that the movable plate holds the swivel on a weapon once the mounting pin has been placed through the eye provided on the weapon.

Such a sling swivel is serviceable, but it does have drawbacks in that the body is somewhat expensive to machine from a solid piece of metal. Also, the "C"-shaped loop, after a period of time, becomes loose in the main body, resulting in rattling which may draw undesired attention to a hunter or soldier using a weapon equipped with such a sling swivel. Additionally, because the pivot pin's end is exposed as a push button, and because the sling might be pushed laterally, it is possible to inadvertently release such a sling from a weapon.

What is desired, then, is a strong sling swivel, light in weight, which may be produced at lower cost than those presently available, which does not create undesirable rattling noises, and which is secure in its attachment to a weapon.

SUMMARY OF THE INVENTION

The present invention provides a detachable sling swivel which is sufficiently strong, is lower in cost to manufacture than the previously known detachable sling swivels, which does not rattle, and which is highly resistant to being inadvertently released.

The sling swivel of the present invention includes in a preferred embodiment a strap-receiving loop of molded plastic, preferably reinforced as by glass fibers. An integrally molded neck extends away from one side of the loop to receive a fixedly attached connecting link member which extends along one side of the neck. This fixed link member is held in place by a fastener, preferably a rivet, with a head of the fastener exposed prominently on the opposite side of the neck. A pivot shaft extends through the neck generally parallel to the fastener and has attached thereto a movable link member which includes an appropriately located aperture which is large enough to fit slidably over the head of the fastener that attaches the other link to the molded plastic neck. A mounting pin extending parallel to the pivot shaft is fastened in one of the links and fits slidably into a hole provided in the other link. Sufficient room is provided between the end of the neck and the mounting pin to permit the mounting pin to extend through the eye located on a weapon in the same manner used with the previously known detachable sling swivels.

Attachment of the fixed link member to the neck of the loop by a rivet provides a secure yet inexpensive connection. Additionally, and more importantly, the rivet head's slidable fit in the aperture in the movable link member provides a balancing of the loads carried by the two link members so that the loads are shared and are applied to the plastic material of the neck of the loop in a direction avoiding excessive stress concentrations.

The pivot shaft extends through the neck and through a hole provided in the fixed link, and is spring biased toward the closed configuration. The pivot shaft may, however, be moved axially, moving the movable link away from the fixed link and neck, disengaging the aperture in the movable link from around the rivet head, and moving the end of the mounting pin from the hole in one of the link members. Thereafter the pivot shaft may be rotated within the neck, moving the movable link to provide access around the mounting pin to permit it to be inserted through an eye provided on a rifle or other weapon with which the sling swivel is to be used.

Protruding from the neck, alongside the movable link member, is a narrow stop member which extends close to the position of the mounting pin in its normal position with the sling swivel attached to a weapon. The stop prevents the eye to which the sling swivel is attached from exerting pressure sideways against the movable link. The stop thus prevents lateral pressure on the sling swivel from pushing the movable link away from the fixed link and thereby disengaging the sling swivel from the weapon to which it is attached. Because of this stop, the mounting pin is located fixedly in the movable link, so that when when the movable link is rotated out of alignment with the fixed link member, the mounting pin may be inserted through the eye of the weapon. As the movable link is rotated back into alignment with the fixed link, the eye of the weapon is permitted to move along with the movable link into a position between the stop member and the fixed link.

Although it is more expensive than use of a plastic loop member, where strength and security against inadvertent release of the sling swivel are paramount considerations, the loop, neck, and fixed link member may be machined from a single piece of material, such as a block of metal. In this case the fastener used to attach the fixed link to a plastic loop is unnecessary, and the neck of the loop may be made shorter, thus reducing the overall length of the sling swivel.

It is a principal objective of the present invention to provide a sling swivel including a stop member which prevents lateral pressure exerted through the sling with which the sling swivel is used from releasing the sling swivel from a weapon.

It is another objective of the present invention to provide an improved sling swivel which is cheaper to manufacture than previously known sling swivels.

It is another important objective of the present invention to provide a detachable sling swivel which resists inadvertent detachment.

It is an important feature of the present invention that it provides a detachable sling swivel including a molded plastic loop.

Another important feature of the present invention is the provision of a fixed link member secured to a neck portion of a plastic loop by a rivet whose head helps a movable link to carry the load of the sling swivel.

It is a principal advantage of the present invention that it provides a sling swivel which is less expensive to manufacture than previously known sling swivels.

It is another important advantage of the present invention that it provides a sling swivel which is quieter than previously known sling swivels.

It is a further advantage of the present invention that it provides a sling swivel which is easily detachable when detachment is intended, but otherwise more secure against inadvertent release than previously known sling swivels.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view of an exemplary rifle equipped with a sling and a pair of sling swivels embodying the present invention.

FIG. 2 is a pictorial view, on an enlarged scale, of one of the detachable sling swivels shown in FIG. 1.

FIG. 3 is a sectional view, taken along line 3—3, of the sling swivel shown in FIG. 2.

FIG. 4 is a sectional view, taken along line 4—4 of the sling swivel shown in FIG. 2.

FIG. 5 is a view of the sling swivel shown in FIG. 2, shown partly in section view taken along line 5—5.

FIG. 6 is a view similar to FIG. 5, showing the movable link member of the sling swivel moved laterally from its normal position.

FIG. 7 is a pictorial view of the sling swivel shown in FIG. 2, showing the movable link positioned to allow detachment of the swivel from a rifle.

DETAILED DESCRIPTION OF THE PREFERRED EMBODIMENTS

Figure 8:
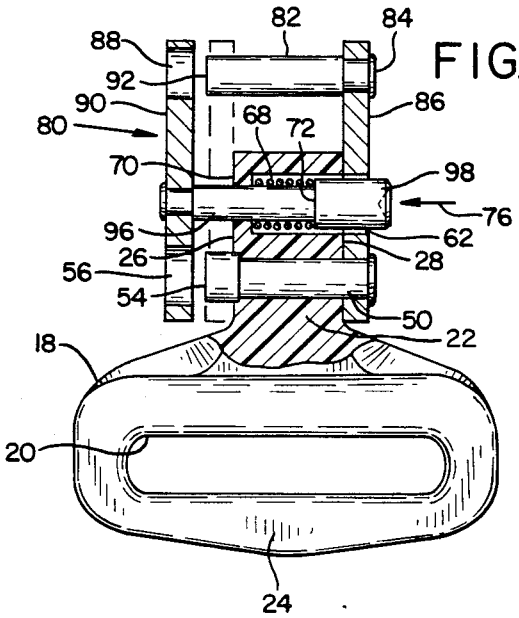
FIG. 8 is a partially sectional top plan view of a sling swivel which is a different embodiment of the invention.

Referring now to the drawings, a rifle 10 shown in FIG. 1 is equipped with a sling 12 detachably connected to the rifle 10 by a pair of sling swivels 14 fastened to respective eyes 16 which are permanently mounted on the rifle 10.

Referring now to FIGS. 2–4, the detachable sling swivel 14 includes a loop 18 which may be constructed of a suitable molded material such as a suitably hard plastic material reinforced by glass fibers. The loop 18 defines an elongate opening 20 which is oriented transversely relative to a neck portion 22, permitting the leather strap or fabric web material of the sling 12 to pass through the opening 20 and be supported across its entire width. A back portion 24 of the plastic loop 18 is of increased thickness to provide structural stiffening of the plastic loop 18.

The neck 22 includes respective first and second sides 26 and 28 and top and bottom surfaces 30 and 32. A first, movable, link member 34 and a second, fixed, link member 36 extend along the neck 22, respectively, on the first side 26 and the second side 28 thereof, when the detachable sling swivel 14 is in its normal closed configuration. The first link member 34 includes grips such as ears 38 which extend above and below the top and bottom surfaces 30 and 32. A stop member 40 extends from the neck between the movable and fixed links 34 and 36, alongside the movable link 34. A mounting pin 42 extends between the movable and fixed link members 34 and 36 and may be placed through an eye such as the eye 16 to attach the sling swivel to a rifle 10 or the like. The mounting pin 42 has an inner end 44 which is fixedly connected, as by riveting, to the movable link member 34, and an outer end 46 is slidably receivable snugly within a mounting pin hole 48 defined in the fixed link member 36. Alternatively, the mounting pin 42 might be fixedly connected to the fixed link member 36 and be slidably receivable within a mounting pin hole defined in the movable link member 34 without departing from the concept of the present invention, if the stop member 40 is omitted.

The second, or fixed, link member 36 is immovably connected to the neck portion 22 of the loop member 18 by a cross pin 50, preferably a rivet extending through a bore 52 defined in the neck 22 and extending transversely therethrough. A head portion 54 of the cross pin 50 protrudes from the neck 22 on the first side 26 thereof while the fixed link member 36 is held closely alongside the opposite side 28 of the neck portion 22 by the other end of the cross pin 50. The head portion 54 is preferably generally cylindrical in shape. An aperture 56, defined in the movable link member 34, permits the movable link member 34 to fit closely alongside the first side 26 of the neck portion 22, with head 54 of the cross pin 50 slidably engaged within the aperture 56. The aperture 56 preferably fits closely about the head 54 when the outer end 46 of the mounting pin 42 is located in the mounting pin hole 48.

Normally, the movable link member 34 is held tightly alongside the first side 26 of the neck portion 22, with outer end 46 of the mounting pin 42 inserted within the mounting pin hole 48 and the head 54 of the cross pin 50 located within the aperture 56, by a pivot shaft 58 which is fixedly connected, for example by riveting, to the movable link member 34. The pivot shaft 58 is engaged in a bore 60 extending through the neck 22. The bore 60 is located further than the bore 52 from the opening 20 and extends parallel to the cross pin 50 and the bore 52. The pivot shaft 58 extends additionally through a pivot shaft hole 62 defined in the second, or fixed, link member 36. The pivot shaft hole 62 is of a large enough diameter to receive a larger diameter distal end portion 64 of the pivot shaft 58, and a portion 66 of the bore 60 is also of a similar diameter. A helical compression spring 68 is located within the large diameter portion 66 of the bore 60, surrounding the pivot shaft 58. The respective ends of the partially compressed spring 68 rest against an abutment 70 located at the bottom of the enlarged portion 66 of the bore and against a shoulder 72 defining the bottom of the distal end portion 64 of the pivot shaft 58. The force exerted by the spring 68 holds the movable link 34 tightly against the first side 26 of the neck portion 22 of the loop 18, with the outer end 46 of the mounting pin 42 located in the mounting pin hole 48 and the head 54 located within the aperture 56, when the sling swivel 14 is attached to a weapon such as the rifle 10.

The distal end portion 64 of the pivot shaft 58 may include a central depression such as a shallow conical socket 74 facing away from the movable link 34 to receive a pointed object such as the nose of a bullet used to press axially against that end of the pivot shaft 58.

When the sling 12 is to be detached from or attached to the rifle 10, the sling swivel 14 may be opened by moving the pivot shaft 58 in the direction indicated by the arrow 76 of FIGS. 5 and 6, compressing the spring 68 and moving the movable link member 34 laterally away from the first side 26 of the neck 22. Once the outer end 46 is clear of the mounting pin hole 48 and the aperture 56 is clear of the head 54, the movable link 34 may be rotated in either direction as indicated by the arrow 78, shown in FIGS. 2 and 7, permitting the mounting pin 42 to be removed from or inserted into the eye 16, as desired. This may be accomplished either by pushing against the distal end portion 64 of the pivot shaft 58 with a sharp object, or by grasping the ears 38 of the movable link 34 and pulling the movable link 34 laterally against the pressure of the spring 68.

Thereafter, the movable link member 34 is rotated to its normal orientation parallel with the fixed link 36 and pressure against the spring 68 is released, permitting the movable link member 34 to resume its normal position closely alongside the first side 26 of the neck portion 22. The distal end portion 64 is preferably flush with the outer surface of the fixed link 36, or protrudes less than the distance by which the outer end 46 extends within the mounting pin hole 48 when the sling swivel 14 is in its normal closed configuration.

When the sling swivel 14 is in its normal closed configuration, the forces exerted on the loop 18 by the sling 12 are transferred to the neck 22 through the cross pin 50, being carried by both the movable and fixed link members 34 and 36 and the mounting pin. A portion of the load may also be shared by the pivot shaft 58, but the snug sliding fit of the mounting pin hole 48 over the outer end 46, and of the aperture 56 over the head 54, permit the fixed and movable link members 34 and 36, the mounting pin 42, and the cross pin 50 to cooperate as a rigid load carrying unit.

Referring now to FIG. 8, a detachable sling swivel 80 is similar in most respects to the sling swivel 14 shown in FIGS. 2–7. There are three notable exceptions. First, a mounting pin 82, corresponding to the mounting pin 42 of the first embodiment of the invention, is mounted, as by riveting its inner end 84 into an aperture provided, in a fixed link 86 of the sling swivel 80. A mounting pin hole 88 is provided in a movable link 90 in position to receive the outer end 92 of the mounting pin 82.

Since the mounting pin 82 remains stationary with respect to the fixed link 86, the neck 94 of the sling swivel 80 does not include a stop such as the stop 40, and clearance is provided for an eye such as the eye 16 of the rifle 10 to slide along the mounting pin 82 from its outer end 92 toward the fixed link 86.

Finally, the sling swivel 80 differs from the sling swivel 14 in that the pivot shaft 96 extends through the neck 94 and protrudes beyond the fixed link 86. The distal end 98 of the pivot shaft 96 may be used as a push button to be pushed axially, compressing the spring 68 and moving the movable link 90 as desired to open and close the sling swivel 80.

Figure 9:
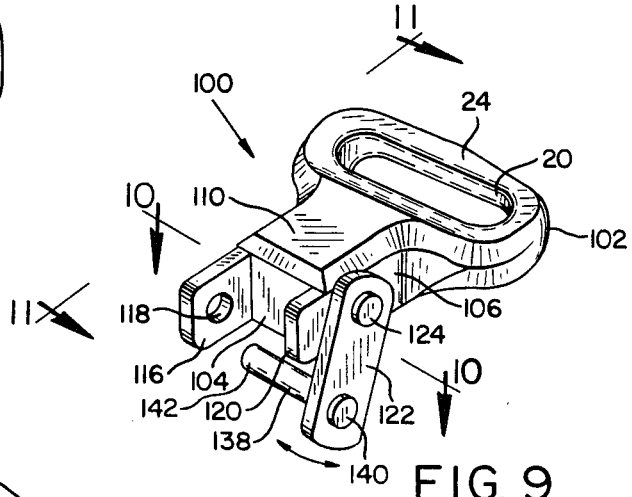
FIG. 9 is a pictorial view of a sling swivel which is yet another embodiment of the present invention.
Figure 11:
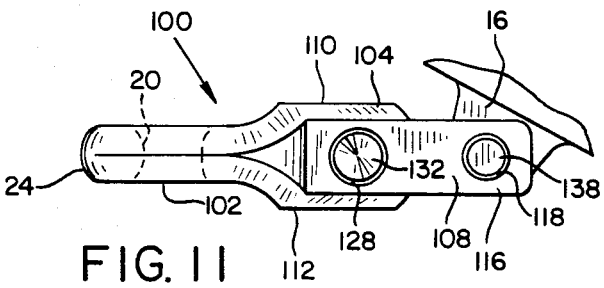
FIG. 11 is a side elevational view of the sling swivel shown in FIG. 9, taken along line 11—11.
Figure 10:
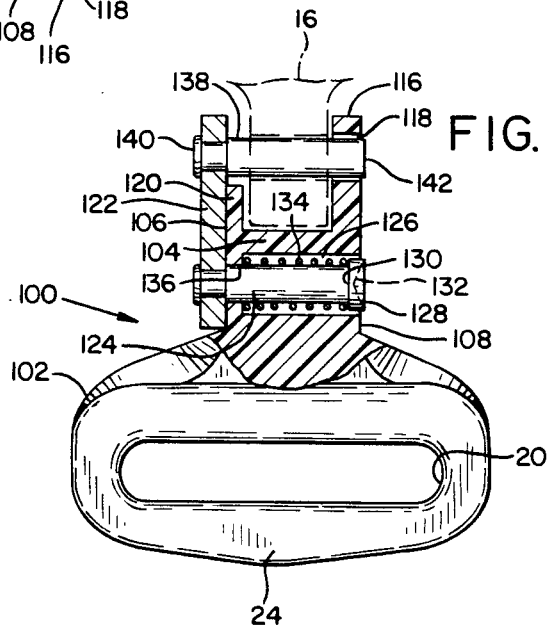
FIG. 10 is a partially sectional top plan view of the sling swivel shown in FIG. 9, taken along line 10—10.

Referring now also to FIGS. 9–11, a detachable sling swivel 100 is yet a further embodiment of the present invention. The sling swivel 100 comprises a loop 102, with a neck portion 104 extending laterally from one side of the loop 102. The neck 104 includes respective first and second sides 106 and 108, and top and bottom surfaces 110 and 112, corresponding to the first and second sides 26 and 28 and top and bottom surfaces 30 and 32 of the sling swivel 14. A side member 116, corresponding to the fixed link 36 of the sling swivel 14, extends from the neck 104 and includes a mounting pin hole 118. Extending from the opposite side of the neck 104 is a stop member 120, corresponding to the stop member 40 of the sling swivel 14 previously described. All of the just-described portions of sling swivel 100 may be of unitary construction, for example being machined from a single piece of metal or molded as a single piece of another structural material such as a reinforced plastic material of suitable strength and rigidity. Since the side member 116 is integral with the neck 104, a cross pin such as the cross pin 50 of the sling swivel 14 is unnecessary, and the neck 104 can be of correspondingly shorter length than the neck 22. A first or movable link 122 is attached to the neck 104 by a pivot shaft 124, similar to the pivot shaft 58 of the sling swivel 14. The pivot shaft 124 is attached to the movable link 122 preferably by riveting. The pivot shaft 124 is engaged in a bore 126 extending through the neck 104, and includes a distal end 128 defining a shoulder 130 facing toward the movable link 122 and a central depression 132 facing axially away from the movable link 122. A helical compression spring 134 is located within the bore 126, surrounding the pivot shaft 124, with one end of the spring 134 resting against a bottom abutment 136 of the bore 126 and the other end resting against the shoulder 130, compressing the spring 134. The force exerted by the spring 134 against the shoulder 130 ordinarily holds the movable link 122 tightly against the first side of the neck portion 104.

Fixedly connected with the opposite end of the movable link 122 is a mounting pin 138 which extends parallel with the pivot shaft 124 and which may be attached to the movable link 122 by being riveted in place at its inner end 140. An outer end 142 of the mounting pin 138 extends ordinarily into the mounting pin hole 118.

Since the movable link 122 does not include a grip comparable to the ears 38 of the sling swivel 14, and since the distal end 128 is approximately flush with or protrudes only slightly beyond the second side 108, the sling swivel 100 is particularly secure against inadvertently being released from a weapon such as the rifle 10;

nevertheless, once the pivot shaft 124 is moved axially, as by pushing a pointed object into the depression 132, it is a simple matter to disengage the sling swivel 100. The detachable sling swivel 100 is thus an exceptionally secure and compact device.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A detachable sling swivel comprising:

(a) loop means for receiving a sling therethrough, said loop means having a neck attached thereto, said neck having opposed first and second sides and defining at least a first bore extending therethrough;

(b) a first link disposed movably adjacent said first side of said neck;

(c) a pivot shaft fixedly connected to said first link, said pivot shaft extending into said first bore;

(d) biasing means associated with said pivot shaft for urging said first link toward said neck;

(e) a mounting pin having an inner end and an outer end, said inner end being fixedly connected to said first link;

(f) means defining a mounting pin hole, said means defining a mounting pin hole being fixedly connected with said neck portion, for receiving said outer end of said mounting pin, said pivot shaft being movable axially within said first bore and said first link and said mounting pin being movable therewith far enough to remove said outer end from said mounting pin hole, and said pivot shaft being rotatable within said first bore, said first link and said mounting pin being rotatable therewith, when said outer end is removed from said mounting pin hole; and (g) stop means, spaced apart from said means defining a mounting pin hole and extending from said neck and away from said first bore, for protecting said first link from application of pressure in a direction tending to move said first link away from said neck, said first link being located alongside said stop means when said outer end is located in said mounting pin hole.

2. The sling swivel of claim 1, said pivot shaft having a distal end exposed beyond said second side by a distance which is less than the distance to which said mounting pin is received in said mounting pin hole when said first link is located alongside and in contact with said first side of said neck.

3. The sling swivel of claim 2 wherein said distal end defines depression means for receiving a pointed object for pushing said pivot shaft axially and thereby moving said first link away from said neck.

4. The sling swivel of claim 1, said first link member including grip means for being grasped for moving said first link member away from said neck.

5. The sling swivel of claim 4, said neck including top and bottom surfaces and said grip means comprising at least one ear protruding beyond at least one of said top and bottom surfaces.

6. The sling swivel of claim 1 including a second bore defined in said neck, a second link member fixedly located adjacent said second side of said neck and including said means defining a mounting pin hole, and a cross pin extending through said second bore and holding said second link member fixedly alongside said second side of said neck, said cross pin including a head portion protruding from said neck on said first side thereof, said pivot shaft including a distal end portion, and said second link member defining aperture means for slidably receiving said distal end portion of said cross pin when said mounting pin hole receives said outer end, said distal end portion extending beyond said fixed link by a distance less than the distance by which the mounting pin extends into said mounting pin hole when said first link member is located alongside and in contact with said first side of said neck.

7. The sling swivel of claim 6 wherein said distal end portion defines depression means for receiving a pointed object for pushing said pivot shaft and thereby moving said first link member away from said neck.

8. The sling swivel of claim 1, said biasing means comprising a compressible, helical spring disposed within said first bore, abutment means located within said first bore for retaining an end of said spring, and shoulder means located on said pivot shaft for retaining an opposite end of said spring.

9. The sling swivel of claim 1, wherein said means defining a mounting pin hole is associated with said second side of said neck and said mounting pin extends from said first link generally toward said second side of said neck.

10. A detachable sling swivel comprising:

(a) loop means for receiving a sling therethrough;

(b) a neck attached to said loop means, said neck having opposing first and second sides and defining first and second bores extending therethrough;

(c) first and second link members disposed adjacent said first and second sides of said neck, respectively;

(d) a pivot shaft fixedly connected to said first link member, said pivot shaft extending axially into said first bore and being axially and rotatably movable therein;

(e) biasing means associated with said pivot shaft for urging said first link member toward said second link member;

(f) a mounting pin having an outer end and having an inner end fixedly connected to one of said link members, the other one of said link members including means defining a mounting pin hole for receiving said outer end of said mounting pin;

(g) a cross pin extending through said second bore and holding said second link member fixedly alongside said second side of said neck, said cross pin including a head portion protruding from said neck on said first side thereof; and (h) means defining an aperture in said first link member, for slidably receiving said head of said cross pin, said first link and pivot shaft together being manually movable away from said neck in opposition to said biasing means, far enough to remove said outer end of said mounting pin from said mounting pin hole and said head of said cross pin from said aperture, in order to free said first link and pivot shaft to be rotated relative to said neck.

11. The sling swivel of claim 10 wherein said pivot shaft is located between said mounting pin and said cross pin.

12. The sling swivel of claim 10, said biasing means comprising a compressible spring disposed within said first bore, abutment means located within said first bore for retaining a first end of said spring, and shoulder means located on said pivot shaft for retaining an opposite end of said spring.

13. The sling swivel of claim 10 wherein said pivot shaft has a distal end located slidingly within said first bore and wherein said head of said cross pin is generally cylindrical and is located slidingly within said aperture means, when said first link is located in contact with said first side and said mounting pin outer end is engaged in said mounting pin hole.

14. The sling swivel of claim 10 wherein said loop is of fiber-reinforced plastic.

15. The sling swivel of claim 10 wherein said pivot shaft has a distal end which is exposed on said second side of said neck approximately flush with said second link member when said first link member is located closely adjacent said first side of said neck.

16. A detachable sling swivel comprising:

(a) loop means for receiving a sling therethrough, said loop means having a neck attached thereto, said neck having opposed first and second sides and defining at least a first bore extending therethrough;

(b) a first link disposed movably adjacent said first side of said neck;

(c) a pivot shaft fixedly connected to said first link, said pivot shaft extending into said first bore and being axially and rotatably movable therein;

(d) biasing means associated with said pivot shaft for urging said first link toward said neck;

(e) a mounting pin having an inner end and an outer end, said inner end being fixedly connected to said first link;

(f) a second link fixedly located alongside said second side of said neck;

(g) means included in said second link for defining a mounting pin hole, for receiving said outer end of said mounting pin;

(h) means for defining a second bore in said neck;

(i) a cross pin extending through said second bore and holding said second link alongside said second side of said neck, said cross pin including a head protruding from said neck on said first side thereof and said first link defining aperture means for slidably receiving said head of said cross pin when said mounting pin hole means receives said outer end; and (j) stop means, extending from said neck alongside said first link, for protecting said first link from application of pressure in a direction tending to move said first link away from said neck, said first link and pivot shaft together being manually movable away from said first side of said neck in opposition to said biasing means, far enough to remove said outer end of said mounting pin from said mounting pin hole and said head of said cross pin from said aperture means, in order to free said first link and pivot shaft to be rotated relative to said neck.

17. The sling swivel of claim 16, wherein said pivot shaft is located between said mounting pin and said cross pin.

18. The sling swivel of claim 16, said pivot shaft having a distal end exposed beyond said second side by a distance which is less than the distance to which said mounting pin is received in said mounting pin hole when said first link is located alongside and in contact with said first side of said neck.

19. The sling swivel of claim 16, said first link member including grip means for being grasped for moving said first link away from said neck.

20. The sling swivel of claim 19, said neck including top and bottom surfaces and said grip means comprising at least one ear protruding beyond at least one of said top and bottom surfaces.

21. The sling swivel of claim 16, said second link defining a pivot shaft hole and said pivot shaft having a distal end exposed through said pivot shaft hole beyond said second link by a distance which is less than the distance to which said mounting pin is received in said mounting pin hole, when said first link is located alongside and in contact with said first side of said neck, and said distal end defining depression means for receiving a pointed object for pushing said pivot shaft axially and thereby moving said first link away from said neck.

22. A detachable sling swivel comprising:

(a) loop means for receiving a sling therethrough, said loop means having a neck attached thereto, said neck having opposed first and second sides and defining at least a first bore extending therethrough;

(b) a first link disposed movably adjacent said first side of said neck;

(c) a pivot shaft fixedly connected to said first link, said pivot shaft extending into said first bore and being axially and rotatably movable therein;

(d) biasing means associated with said pivot shaft for urging said first link toward said neck;

(e) a mounting pin having an inner end and an outer end, said inner end being fixedly connected to said first link;

(f) a second link fixedly located adjacent said second side of said neck;

(g) means included in said second link defining a mounting pin hole, for receiving said outer end of said mounting pin;

(h) stop means, extending from said neck alongside said first link, for protecting said first link from application of pressure in a direction tending to move said first link away from said neck;

(i) means for defining a second bore in said neck;

(j) a cross pin extending through said second bore and holding said second link fixedly alongside said second side of said neck, said cross pin including a head portion protruding from said neck on said first side thereof; and (k) said pivot shaft including a distal end portion, and said second link defining pivot shaft hole means for slidably receiving said distal end portion of said pivot shaft when said mounting pin hole receives said outer end, said distal end portion extending beyond said second link by a distance less than the distance by which the mounting pin extends into said mounting pin hole when said first link is located alongside and in contact with said first side of said neck.

23. The sling swivel of claim 22 wherein said distal end portion defines depression means for receiving a pointed object for pushing said pivot shaft and thereby moving said first link away from said neck.

* * * * *